US007936119B2

(12) United States Patent
Cheng

(10) Patent No.: US 7,936,119 B2
(45) Date of Patent: May 3, 2011

(54) WIDE-ANGLE LED LIGHTING LAMP WITH HIGH HEAT-DISSIPATION EFFICIENCY AND UNIFORM ILLUMINATION

(75) Inventor: Yung Pun Cheng, Macau (CN)

(73) Assignee: Yung Pun Cheng (CN)

( * ) Notice: Subject to any disclaimer, the term of this patent is extended or adjusted under 35 U.S.C. 154(b) by 135 days.

(21) Appl. No.: 12/407,562

(22) Filed: Mar. 19, 2009

(65) Prior Publication Data

US 2010/0096966 A1 Apr. 22, 2010

(30) Foreign Application Priority Data

Oct. 16, 2008 (CN) ..... 2008 2 0138251 U

(51) Int. Cl.
*H01J 1/62* (2006.01)
*H01J 63/04* (2006.01)

(52) U.S. Cl. ..... 313/498; 313/500; 313/506; 313/512

(58) Field of Classification Search ..... 313/498–500, 313/506, 512; 257/98–100
See application file for complete search history.

(56) References Cited

U.S. PATENT DOCUMENTS 5,404,282 A * 4/1995 Klinke et al. ..... 362/249.06
5,561,346 A 10/1996 Byrne
5,585,783 A 12/1996 Hall
5,655,830 A 8/1997 Ruskouski
5,688,042 A 11/1997 Madadi et al.
5,726,535 A 3/1998 Yan
5,806,965 A 9/1998 Deese
D405,201 S 2/1999 Lodhie
5,921,660 A 7/1999 Yu
D415,582 S 10/1999 Camarota
D434,510 S 11/2000 Lodhie
D435,920 S 1/2001 Camarota et al.
6,220,722 B1 * 4/2001 Begemann ..... 362/231
6,227,679 B1 5/2001 Zhang et al.
6,465,961 B1 10/2002 Cao
6,499,860 B2 12/2002 Begemann
6,502,956 B1 1/2003 Wu
6,517,217 B1 2/2003 Liao
6,523,978 B1 2/2003 Huang
6,525,668 B1 2/2003 Petrick
6,621,222 B1 9/2003 Hong
6,659,632 B2 12/2003 Chen
6,719,446 B2 4/2004 Cao
6,746,885 B2 6/2004 Cao
6,773,139 B2 8/2004 Sommers
6,982,518 B2 1/2006 Chou et al.
7,086,756 B2 8/2006 Maxik
7,207,694 B1 * 4/2007 Petrick ..... 362/240
(Continued)

OTHER PUBLICATIONS

PCT/CN2009/000827, International Search Report and Written Opinion of the International Searching Authority mailed Nov. 5, 2009.

*Primary Examiner* — Joseph L Williams
*Assistant Examiner* — Kevin Quarterman
(74) *Attorney, Agent, or Firm* — Baker & McKenzie LLP

(57) ABSTRACT

LED lighting lamps provide optimum heat dissipation efficiency, wide illumination beam angles, and substantially uniform illumination intensity. Generally, the disclosed LED lamps comprise at least one LED lighting element and a substrate with a plurality of inclined planes.

19 Claims, 4 Drawing Sheets

U.S. PATENT DOCUMENTS

| | | | | |
|---|---|---|---|---|
| 7,210,818 | B2 | 5/2007 | Luk et al. | |
| 7,224,001 | B2 | 5/2007 | Cao | |
| 7,296,913 | B2 | 11/2007 | Catalano et al. | |
| 7,319,293 | B2 | 1/2008 | Maxik | |
| 7,354,174 | B1 | 4/2008 | Yan | |
| 2003/0040200 | A1* | 2/2003 | Cao | 438/800 |
| 2006/0126328 | A1* | 6/2006 | Coushaine | 362/247 |
| 2006/0193130 | A1* | 8/2006 | Ishibashi | 362/227 |
| 2006/0255352 | A1 | 11/2006 | Lin et al. | |
| 2008/0285276 | A1* | 11/2008 | Okamitsu et al. | 362/243 |

* cited by examiner

WIDE-ANGLE LED LIGHTING LAMP WITH HIGH HEAT-DISSIPATION EFFICIENCY AND UNIFORM ILLUMINATION

CROSS-REFERENCE TO RELATED APPLICATIONS

This patent application relates and claims priority to Chinese patent application 200820138251.6 filed Oct. 16, 2008, which is herein incorporated by reference for all purposes.

BACKGROUND

1. Technical Field

The present invention generally relates to light-emitting diode (LED) lamps. More specifically, the present invention relates to LED lamps with high heat-dissipation efficiency, wide illumination beam angles, and substantially uniform illumination intensity.

2. Background

With recent developments in LED technologies, high-powered LED lamps are more frequently designed for use in household lighting applications. Compared with light sources currently used in homes, such as incandescent lights, LED lamps provide advantages such as ample brightness, energy savings, high reliability, and long life span.

Current commercially available LED lamps involve a plurality of packaged LEDs arranged in an array on a plane. Although this type of LED lamp may meet common lighting needs, the LED lighting elements are distributed on the same plane and, thus, the light being radiated from the LED lamp is highly directional and has a relatively narrow beam angle. In addition, this type of LED lamp lacks a good heat-dissipation structure which limits the life span due to the LEDs overheating. The heat dissipation issue can be solved by installing a radiator on the back of the base plane. For high-powered LED lighting elements, however, the packaging, including the adhesive base and the glass bubble, still interferes with effective heat dissipation.

The problem of a narrow beam angle has been addressed in LED lamp systems with both a plurality of LEDs and an LED carrier. These structures expand the beam angle, but the illumination intensity is not distributed in a uniform manner.

Accordingly, there is a need for an LED lamp with good heat-dissipation efficiency, wide illumination beam angles, and uniform illumination intensity.

BRIEF SUMMARY

This disclosure pertains to LED lamps, and in particular to LED lamps having a substrate with a plurality of inclined planes. The LED lamps provide adequate heat-dissipation efficiency, wide illumination beam angles, and substantially uniform illumination intensity.

According to an aspect, the LED lamp includes a substrate bearing LED lighting elements and a heat sink connected with the substrate. The LED lighting elements are distributed on at least one inclined plane of the substrate.

DETAILED DESCRIPTION

Known LED lamps lack good heat-dissipation efficiency in conjunction with wide illumination beam angles and uniform illumination intensity. To address common lighting needs, a plurality of LEDs may be arranged in an array on a plane, as disclosed in Chinese Pat. App. No. 01103850.0 (Pub. No. 1372096), entitled "LED Illumination Lamp" to T. Wang. In this configuration, a plurality of LEDs are installed with a sealing adhesive on planar base plates of an LED lamp housing and printed circuit boards are installed between the housing and lamp cap. This arrangement lacks adequate heat-dissipation limiting the lamp's life-span. This arrangement also suffers from inadequate breadth of illumination angles. To address the narrow beam angle design, a plurality of LEDs may be used in conjunction with an LED carrier, as disclosed in Chinese Pat. App. No. 200710044917.1 (Pub. No. 101182916), entitled "LED Lamps" to X. Zhan. Zhan discloses an LED carrier with multiple LED bearing planes—one of which is planar and another of which is inclined. LEDs are then distributed on the planes in a circle, at angularly equidistant points, which expands the beam angles but, due to the discontinuity between the inclined planes and the LEDs on the inclined planes being on a spherical surface, the illumination intensity is still non-uniform. Generally, disclosed embodiments seek to maximize heat-dissipation efficiency while providing wide illumination beam angles and uniform illumination intensity.

Figure 1:
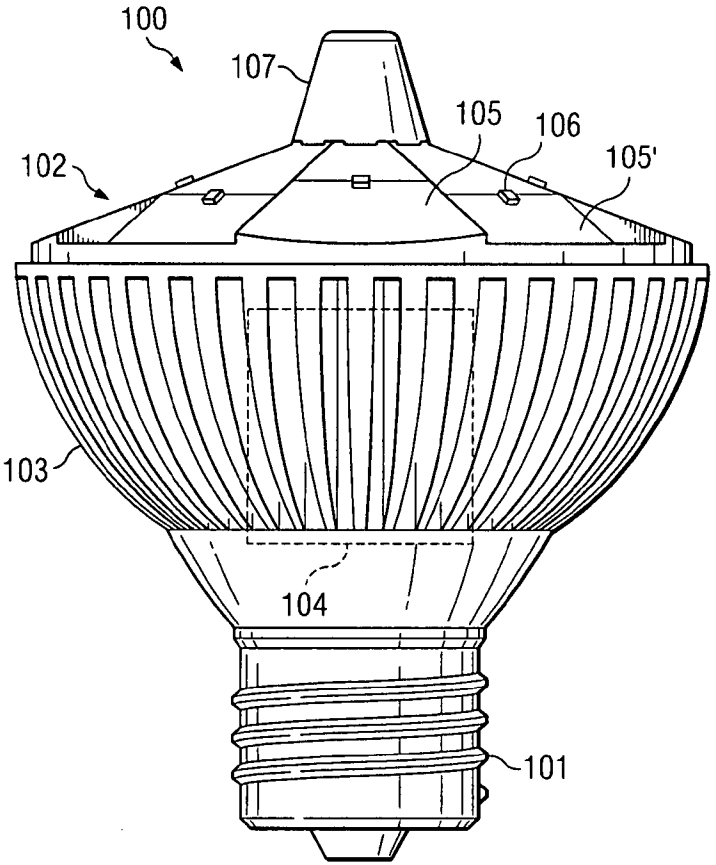
FIG. 1 is a drawing illustrating a side view of an LED lamp, in accordance with the present disclosure.

FIG. 1 is a drawing illustrating a side view of a first embodiment of an LED lamp 100. A lamp holder 101 is connected to an alternating current power source to supply power to the LED lamp 100. The lamp holder 101 may be of the same specification as common lighting lamps, making it easier to substitute an LED lamp in for fluorescent bulbs currently used for lighting. The substrate 102 may be a cast-formed metal module. Inclined planes 105 and 105' are surfaces of the substrate and may be formed through mechanical machining technology. Inclined planes 105 and 105' may be formed by cutting different inclination angles relative to a plane perpendicular to the central axis of the LED lamp 100. The inclined planes 105 and 105' may also be coated, e.g., by electroplating, to increase reflectivity of the substrate. Mechanical machining and electroplating may be achieved using known methods in this field.

The LED lighting elements 106 may be placed at the junctions or edges of the inclined planes. The LED lighting elements 106 may be phosphor and bare, i.e. without the adhesive base, heat-dissipating substrate, pins, or a glass fixture. LED lighting elements 106 may be attached using heat conducting adhesive. Using bare LED lighting elements 106 improves heat dissipation. Placing LED lighting elements 106 at the junction or edges of the inclined planes increases the range of light angles emitted by the lighting elements via reflection off the inclined planes 105, 105' at the junctions. LED lighting elements 106 may also be placed elsewhere on the inclined planes. Depending on the requirements of illumination, the number of LED lighting elements 106 on each plane 105, 105' may be adjusted accordingly. The number of LED lighting elements 106 on each plane 105, 105' may be zero, one, or more than one.

The heat sink 103 and the substrate 102 can be formed as one part, or can be formed separately and subsequently assembled. The outside of the heat sink 103 may comprise a considerable number of highly-efficient fin-shaped radiating structures to increase the contact area with air. The heat from the LED lighting elements 106 is transferred directly by conduction and dissipated through the fin-shaped radiation structures of the heat sink 103, resulting in higher heat dissipation efficiency. A reflector 107 may be positioned at the central axis of the substrate 102. The reflector 107 may be a round shape. The reflector 107 may also be square-shaped or any other shape.

Figure 2:
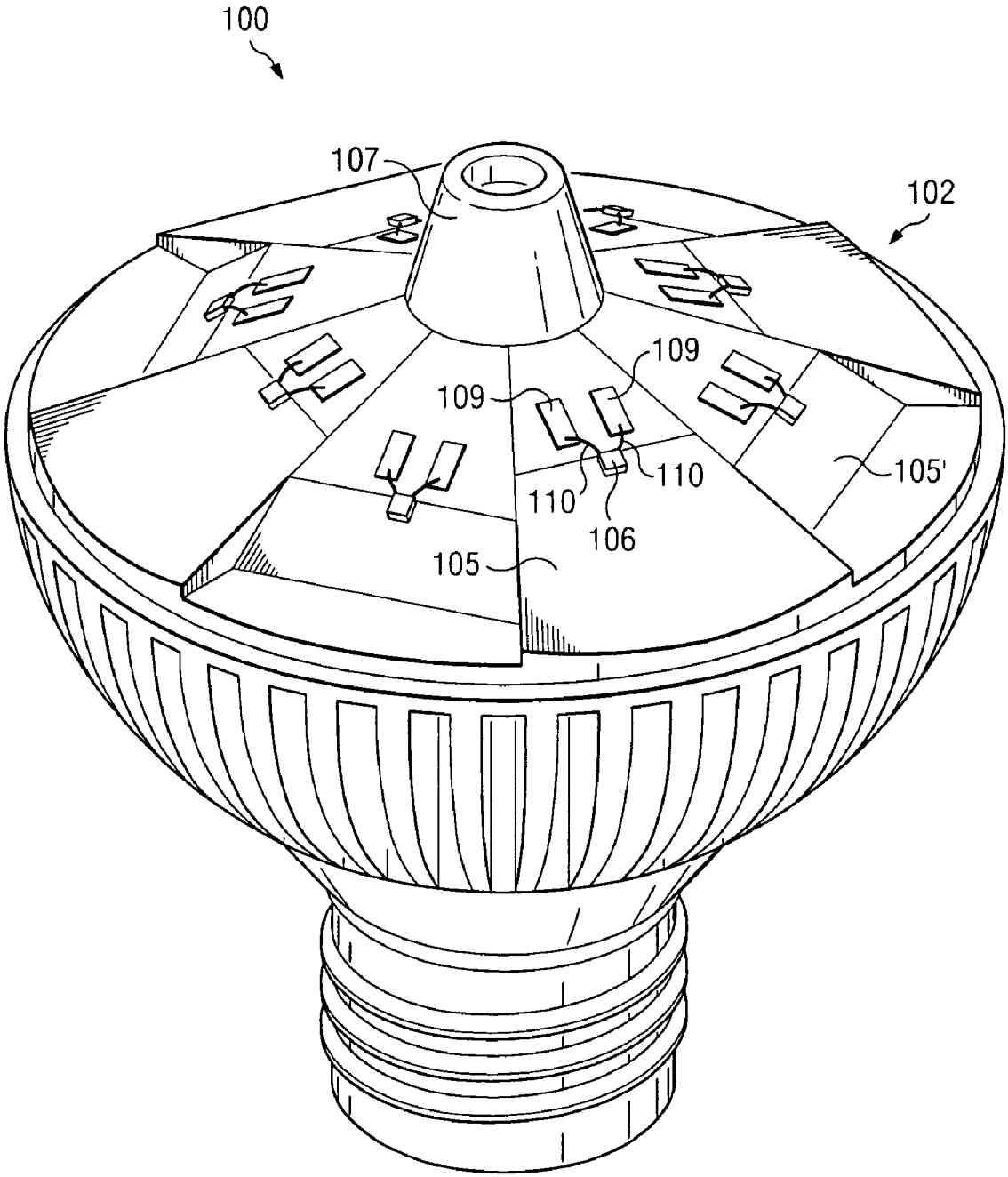
FIG. 2 is a perspective view of an LED, in accordance with the present disclosure.

FIG. 2 is a perspective view of the LED lamp 100. The inclined planes 105 and 105' are radially distributed around a central axis and form two levels with varying inclination angles, depending on the radial direction. The inclined planes may also be distributed symmetrically. The inclined planes in the same radial direction gradually incline downward from the center to the periphery. The inclined planes of the first level, i.e. those that are adjacent to the reflector 107, collectively form a shape resembling a prism frustum. The prism frustum may have any number of sides from three to eight, or more. Through proper mechanical machining technology, the inclined planes of the second level around the periphery form an alternating distributed structure. That is, two adjacent inclined planes have different inclination angles, e.g., the inclination angle of the inclined plane 105' is greater than that of the inclined plane 105. LED lighting elements 106 are located on the inclined planes (which have gradually-increasing inclination angles as one goes from the center to the periphery) or at the junctions or edges of the inclined planes, thus, the range of light angles emitted from the lighting elements is increased, and the overall illumination beam angle is expanded accordingly. In a preferred embodiment, inclination angles of the inclined planes on the substrate 102 is preferably within the range of 10° to 80° relative to a plane perpendicular to the central axis of the LED lamp. The inclination angles of the adjacent inclined planes at the second level may be set as 10° and 80 °, 20° and 70°, or 15° and 60°, etcetera, from a plane perpendicular to the central axis.

LED lighting elements 106 are connected to two power wire interfaces 109 by two thin bonding wires 110 in order to draw power. The bonding wires 110 are preferably the commonly available wires. The LED wire interfaces 109 are small metal sheets inserted in, and electrically insulated from, the substrate 102.

Figure 3:
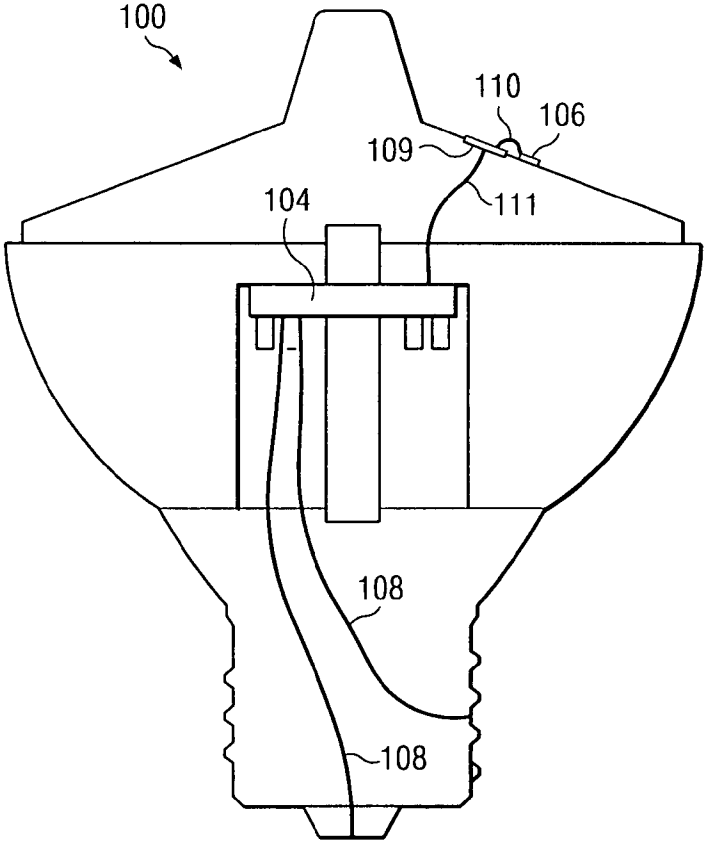
FIG. 3 is a schematic diagram illustrating internal circuit connections of an LED lamp, in accordance with the present disclosure.

FIG. 3 is a schematic diagram illustrating the internal circuit connection of the LED lamp 100. A direct current (DC) circuit board 104 may be installed in the internal cavity of the LED lamp 100. The DC circuit board 104 may be a printed circuit board including an alternating current to direct current converter. Such AC to DC converters are well known in the field. The DC circuit board 104 also includes a current-control part (not shown in FIG. 3) for each LED lighting element. The input terminal of the converter 104 connects with the lamp base by a conducting wire 108 in order to receive an input AC current. The output terminal of the converter 104 provides DC current to LED lighting elements 106 through a DC wire 111 and through the power wire interfaces 109 and the bonding wires 110. Two DC wires 111 connect with the power wire interface, one with a positive electrode and one with a negative electrode, although the figure only shows one DC wire 111.

Figure 4:
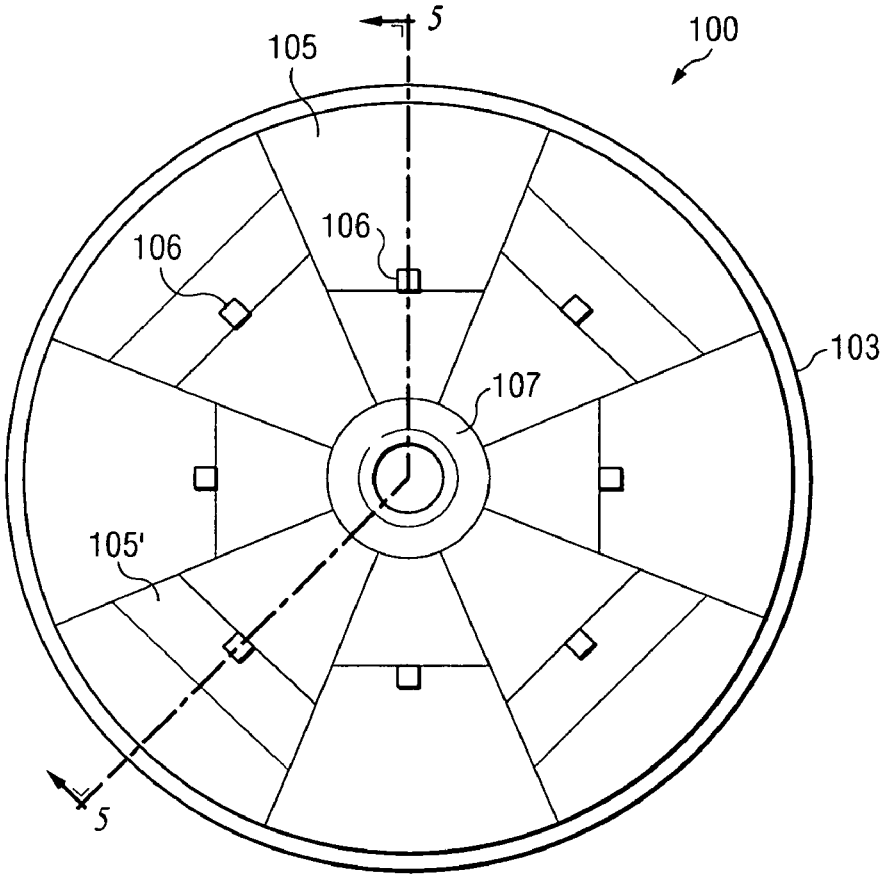
FIG. 4 is a drawing illustrating the top-down view of an LED lamp, in accordance with the present disclosure.
Figure 5:
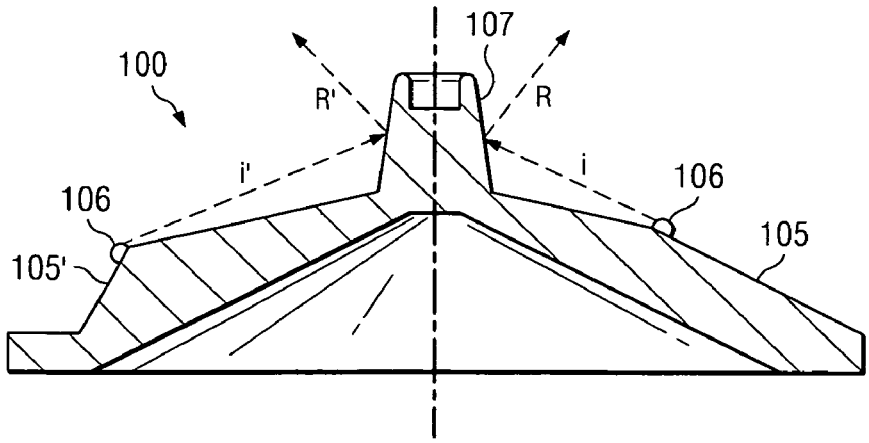
FIG. 5 is a drawing illustrating the cross-sectional view of an LED lamp, in accordance with the present disclosure.

FIG. 4 is a drawing illustrating the top-down view of an embodiment of the LED lamp 100 and FIG. 5 is a drawing illustrating a cross-sectional view along the line 5-5 of FIG. 4. Looking at FIG. 4, the LED lighting elements on the inclined planes 105 and 105' are located on circles of different radii, i.e. the distance between the LED lighting elements on inclined plane 105' and the central axis is greater than the distance between LED lighting elements on inclined plane 105 and the central axis. Consequently, when the light radiated by the LED lighting elements located on the inclined plane 105 and 105' reaches the reflector 107, the angle between the incident ray i' from 105' and the surface of the reflector 107, is greater than the angle between the incident ray i from 105 and the surface of the reflector 107, as shown in FIG. 5. Accordingly the reflection ray R' has a longer distance to travel from the central axis than does the reflection ray R. In this embodiment, relative to the central axis, the light emitted from the LED lighting elements 106 of inclined plane 105' will be incident from a wider light angle than the light emitted from the LED lighting elements 106 of inclined plane 105. This arrangement of light emitted with varying light angles ensures adequate illumination uniformity and enhances the average illumination intensity. Even without the reflector 107, the LED lighting elements 106 located on the inclined planes with different inclination angles will still expand the overall illumination beam angle due to the inclination angles of inclined planes on which the lighting elements are located.

Figure 6:
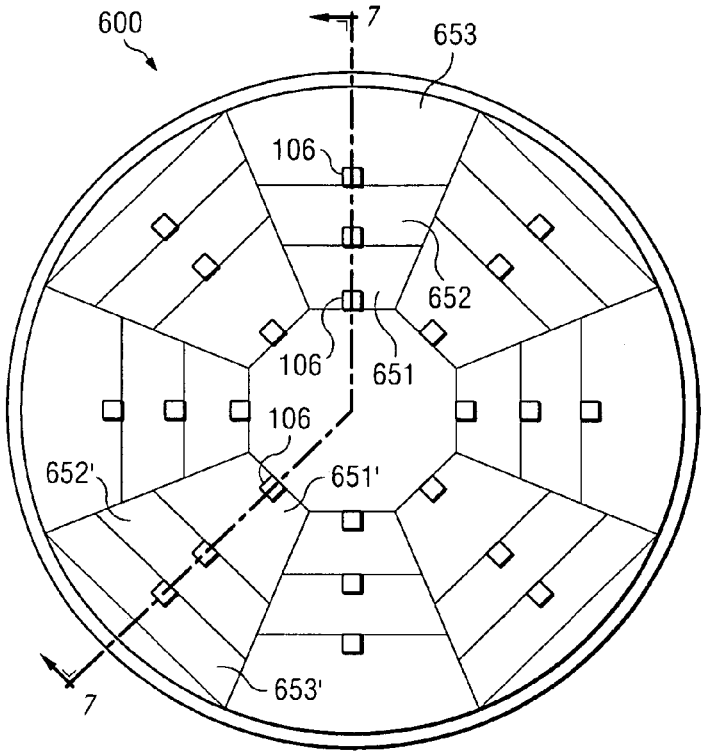
FIG. 6 is a drawing illustrating the top-down view of an LED lamp, in accordance with the present disclosure.
Figure 7:
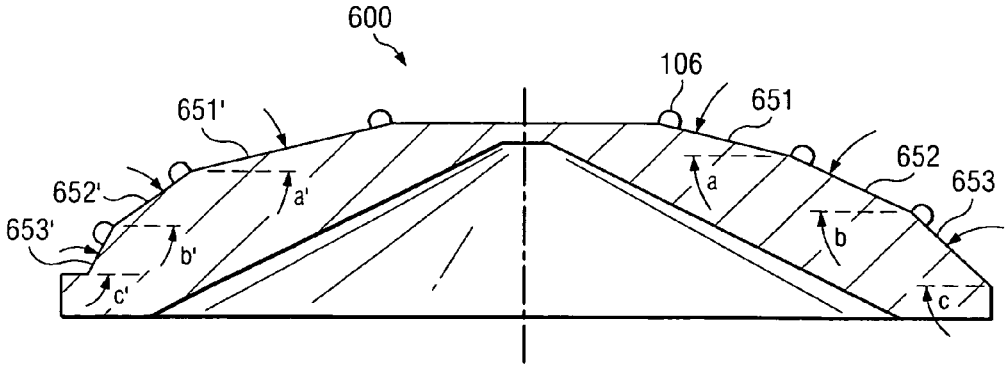
FIG. 7 is a drawing illustrating the cross-sectional view of an LED lamp, in accordance with the present disclosure.

FIG. 6 is a drawing illustrating the top-down view of another embodiment of an LED lamp 600 and FIG. 7 is a drawing illustrating the cross-sectional view along the line 7-7 in FIG. 6. This embodiment of an LED lamp does not have a reflector at the central axis. Instead, a plane is located at the center. The substrate has inclined planes 651, 652, 653, and 651', 652', 653' of more levels (FIG. 6 shows three levels, but more levels may be used). At least one lighting element 106 is placed on each inclined plane of each level. The lighting element may be at the junction or in the middle of the inclined planes (including the central plane). Inclination angles a, b, and c of the inclined planes 651, 652, and 653 in one radial direction, and inclination angles a', b', and c' of the inclined planes 651', 652', and 653' in a second radial direction are shown in FIG. 7. These angles may all be different, but they should still be within the range of 10° to 80° from the horizontal plane. In this structure, the different inclination angles of the inclined planes in the same radial direction ensure illumination uniformity from the center to the periphery. Different inclination angles for inclined planes at the same level ensure optimum illumination uniformity around the entire ring of the overall light beam. The overall average illumination intensity is, thus, notably increased.

While various embodiments in accordance with the principles disclosed herein have been described above, it should be understood that they have been presented by way of example only, and not limitation. Thus, the breadth and scope of the invention(s) should not be limited by any of the above-described exemplary embodiments, but should be defined only in accordance with any claims and their equivalents issuing from this disclosure. Furthermore, the above advantages and features are provided in described embodiments, but shall not limit the application of such issued claims to processes and structures accomplishing any or all of the above advantages.

Additionally, the section headings herein are provided for consistency with the suggestions under 37 CFR 1.77 or otherwise to provide organizational cues. These headings shall not limit or characterize the invention(s) set out in any claims that may issue from this disclosure. Specifically and by way of example, although the headings refer to a "Technical Field," the claims should not be limited by the language chosen under this heading to describe the so-called field. Further, a description of a technology in the "Background" is not to be construed as an admission that certain technology is prior art to any invention(s) in this disclosure. Neither is the "Summary" to be considered as a characterization of the invention(s) set forth in issued claims. Furthermore, any reference in this disclosure to "invention" in the singular should not be used to argue that there is only a single point of novelty in this disclosure. Multiple inventions may be set forth according to the limitations of the multiple claims issuing from this disclosure, and such claims accordingly define the invention(s), and their equivalents, that are protected thereby. In all instances, the scope of such claims shall be considered on their own merits in light of this disclosure, but should not be constrained by the headings set forth herein.

What is claimed is:

1. An LED lamp comprising:

a substrate with a plurality of inclined planes, wherein the inclined planes are radially distributed around a central axis and form a plurality of levels with a plurality of inclination angles, and wherein two adjacent inclined planes of the plurality of inclined planes at the same level of the plurality of levels have substantially different inclination angles;

a heat sink formed together with the substrate into one part; and at least one LED light element located on at least one of the inclined planes.

2. The LED lamp of claim 1, wherein a reflector is positioned on the central axis of the LED lamp, the reflector having an outer surface shaped like one or more circular arcs.

3. The LED lamp of claim 2, wherein the at least one LED light element comprises a bare chip without packaging.

4. The LED lamp of claim 1, wherein two not adjacent inclined planes of the plurality of inclined planes are separated by another inclined plane of the plurality of inclined planes, the two not adjacent inclined planes having substantially the same inclination angle.

5. The LED lamp of claim 1, wherein the levels comprise at least two levels.

6. The LED lamp of claim 1, wherein the inclination angles of the inclined planes are within the range of 10° to 80°, the inclination angles of the inclined planes comprising the angle relative to a plane perpendicular to a central axis of the LED lamp.

7. The LED lamp of claim 1, wherein the substrate and the heat sink comprise metal modules cast-formed into one part.

8. The LED lamp of claim 1, wherein a lateral part of the heat sink comprises fin-shaped flanges.

9. The LED lamp of claim 1, wherein the at least one LED light element is located at a junction of at least two of the inclined planes.

10. An LED lamp comprising:

a substrate; and at least one LED light element;

wherein the substrate comprises a plurality of inclined planes, the inclined planes distributed radially around a central axis of the LED lamp forming a plurality of levels with a plurality of inclination angles; and wherein at least one of the inclined planes has a different inclination angle from an adjacent inclined plane at the same level; and wherein at least one of the inclined planes holds the at least one LED light element.

11. The LED lamp of claim 10, wherein the at least one LED light element comprises a plurality of LED light elements.

12. The LED lamp of claim 10, wherein two not adjacent inclined planes of the plurality of inclined planes are separated by one inclined plane of the plurality of inclined planes, the two not adjacent inclined planes having substantially the same inclination angle.

13. The LED lamp of claim 10, wherein a reflector is positioned on the central axis of the LED lamp, the reflector having an outer surface shaped like one or more circular arcs.

14. The LED lamp of claim 10, wherein the levels comprise at least two levels.

15. The LED lamp of claim 10, wherein the inclination angles of the inclined planes are within the range of 10° to 80°, the inclination angles of the inclined planes comprising the angle relative to a plane perpendicular to the central axis.

16. The LED lamp of claim 10, wherein the at least one LED light element is a bare chip without packaging.

17. The LED lamp of claim 10, the LED lamp further comprising a heat sink connected with the substrate.

18. The LED lamp of claim 17, wherein that the heat sink includes fin-shaped flanges.

19. The LED lamp of claim 10, wherein the at least one LED light element is located at a junction of at least two of the inclined planes.

* * * * *